United States Patent [19]

Pichler et al.

[11] Patent Number: 4,565,127

[45] Date of Patent: Jan. 21, 1986

[54] MECHANISM FOR RECIPROCATING A LINE PRINTER SHUTTLE

[75] Inventors: Josef Pichler, Ebreichsdorf; Karl Puchegger, Föhrenau; Bruno Starek, Vienna, all of Austria

[73] Assignee: Mannesmann Tally GmbH, Vienna, Austria

[21] Appl. No.: 514,948

[22] Filed: Jul. 18, 1983

[30] Foreign Application Priority Data

Jul. 8, 1983 [EP] European Pat. Off. ..... 82 106117.3

[51] Int. Cl.[4] ..... B41J 3/00

[52] U.S. Cl. ..... 101/93.04; 400/290

[58] Field of Search ..... 400/290, 320, 322, 323, 400/317.1, 328, 335, 337, 338.2, 434, 434.2; 101/93.04, 93.05; 74/25, 47; 403/57, 58, 79, 80

[56] References Cited

U.S. PATENT DOCUMENTS

| | | | |
|---|---|---|---|
| 2,834,218 | 5/1958 | Lovell | 74/25 X |
| 3,833,891 | 9/1974 | Howard et al. | 101/93.05 X |
| 3,967,714 | 7/1976 | Potma et al. | 101/93.05 X |
| 4,116,567 | 9/1978 | San Pietro | 101/93.05 X |
| 4,127,334 | 11/1978 | Watanabe et al. | 400/320 X |
| 4,239,403 | 12/1980 | Matula et al. | 400/322 |
| 4,278,019 | 7/1981 | Meier | 101/93.04 |
| 4,306,497 | 12/1981 | Hamada | 101/93.05 |
| 4,359,289 | 11/1982 | Barrus et al. | 400/322 |
| 4,365,488 | 12/1982 | Mochida et al. | 403/57 |
| 4,387,642 | 6/1983 | Bringhurst et al. | 101/93.04 |
| 4,400,104 | 8/1983 | McCray et al. | 400/320 |
| 4,436,440 | 3/1984 | Iwata | 403/57 X |
| 4,446,789 | 5/1984 | Matsumoto et al. | 400/320 X |

FOREIGN PATENT DOCUMENTS

| | | | |
|---|---|---|---|
| 878844 | 8/1971 | Canada | 74/25 |
| 0044415 | 1/1982 | European Pat. Off. | 400/320 |
| 2485674 | 12/1981 | France | 400/328 |
| 0020466 | 2/1983 | Japan | 101/93.04 |
| 111060 | 6/1944 | Sweden | 74/25 |

OTHER PUBLICATIONS

IBM Technical Disclosure Bulletin, "Matrix Scan Printing Method," Pinnichny, vol. 21, No. 1, Jun. 1978, pp. 103–104.

*Primary Examiner*—Ernest T. Wright, Jr.
*Attorney, Agent, or Firm*—Ralf H. Siegemund

[57] ABSTRACT

A rotational movement of a constant speed drive is translated into a linear reciprocating motion having two relatively long, constant slope sections within a cycle, such section occuring in between two sequential reversals, and representing a constant speed. The speed modification is obtained by a universal joint-cross link with oblique axes and a crank output having a linear phase.

11 Claims, 5 Drawing Figures

MECHANISM FOR RECIPROCATING A LINE PRINTER SHUTTLE

BACKGROUND OF THE INVENTION

The present invention relates to a mechanism for reciprocating machine parts such as a carrier of the print elements in a matrix line printer. More particularly, the invention relates to oscillating a print element carrier moving parallel to a platen element in forward and reverse passes and being connected to a drive which basically provides a rotating motion.

Oscillating shuttle mechanisms generally cooperate with an object which extends along the shuttle path and are provided for treatment, processing, observing, measuring or working whereby particularly the shuttle is to move along a particular path and in accordance with a particular velocity profile determined by a particular set of parameters. Related thereto in general are devices in which a work medium, tool, instrument, actuator or the like is to be operated in dependence upon a particular displacement or position. Open loop operation is desirable in this case in order to avoid complex position monitors and transducers as inputs for feedback circuits.

The print element carrier in a matrix line printer requires an operating system which permits the carrier to run at a constant speed over certain displacement path portions or increments and printing requires also position dependent operation. Generally speaking, the print elements on the carrier are constructed to print dots and they are configured, for example, as hammer tips or the tips of wires. These elements are mounted on the carrier particularly so that the respective tips are arranged along a particular line which could be termed horizontal, although the overall position of the printer is generally, or should be independent from such absolute orientation. This horizontal line extends transversely to the direction of the print medium (paper) upon which dots are being printed. During print passes the hammers or wires, i.e., the print element carrier reciprocate back and forth along that horizontal line. The elements themselves are actuated, i.e. caused to advance toward the print element in a direction which is transverse to both the print medium advance and the direction of shuttle reciprocation.

The print elements are actuated individually for purposes of printing to thereby obtain their advance. They are actuated when the shuttle has reached particular predetermined relative positions along the line of reciprocating displacement. Time and position dependent actuation and operation is critical in terms of accuracy because it reflects directly the quality and appearance of the printed characters. Of course, the power and speed of the printer depends on high speed operation in all instances. Obviously a high speed is required if such a printer is an output device in an electronic data processing system.

A shuttle mechanism is disclosed in European Pat. No. 44415 and being comprised essentially of elliptical gears oriented in particular phases in relation to each other. In order to simulate similar motion and displacements, particularly contoured cams or cam shafts have been suggested as an alternative. Also, shuttle mechanisms have been constructed using electromagnetic, i.e. electroinductively operating linear motors. A further approach includes feedback controlled drive motors for the shuttle and print element carrier.

Particularly contoured cams or camshafts are disadvantaged by very high accuracy and tolerance requirements during manufacturing. Detrimental is that the accuracy of operation requires intimate engagement of operating parts with particularly contoured cam surfaces which inevitably produces considerable wear resulting in a relatively short life. Positive connections, however, are not suitable for higher speeds. Linear motors, electromagnetic coils or controlled motors are disadvantaged by the high expenditure that is required to obtain the requisite control. Moreover, these motors consume a considerable amount of power and due to the particular operating mode they have a rather low efficiency while occupying a considerable amount of space.

DESCRIPTION OF THE INVENTION

It is an object of the present invention to provide a new and improved shuttle mechanism for obtaining a reciprocating, i.e. oscillating displacement of a machine part.

It is another object of the present invention to provide a new and improved oscillatory drive mechanism for the print element carrier in a matrix printer.

It is a further object of the present invention to provide an open loop conversion or transformation of a rotatory drive movement into a linear oscillatory movement of a machine part such as the print element carrier in a line matrix printer wherein the motion is predetermined as to accuracy in accordance with a set of parameters.

It is a specific object of the present invention to provide a new and improved shuttle mechanism for obtaining a reciprocating linear movement having forward and reverse passes, at least one pass including a very accurately constant speed section.

It is a specific object of the present invention to provide a new and improved shuttle mechanism for reciprocating the print element carrier in a matrix line printer along a linear path that extends parallel to the platen of the printer permitting printing in the forward as well as in the reverse pass after each reciprocating cycle and wherein the prime motion provided for driving the shuttle mechanism is a rotational one.

In accordance with the preferred embodiment of the present invention, it is suggested to provide a rotational drive such as an electric motor operating at a constant rotational, and angular speed, the drive being coupled to a transmission which modifies the speed cyclically to obtain a rotational output which is not constant. A linkage is provided for connecting the output of the transmission to a machine part such as a print element carrier to be reciprocated along a linear path, the linkage translating the rotational output of the transmission into a linear reciprocating motion. The modification provided by the transmission is such that during each reciprocating cycle there is at least one constant speed section occurring in between two sequential reversals of the reciprocating motion.

The linkage is preferably a crank and the transmission is preferably a universal joint having input and output axes arranged at an angle to each other which is preferably between 30° and 50° with 40° being the preferred value for a reciprocating print element carrier. The transmission can be very simply constructed, and economical, low-noise, low-wear components of proven technical quality can be used. For economic reasons a cross link can be used as a universal joint. The crank and the rotational output of a universal joint may have an adjustable phase shift which is another parameter for modifying the velocity profile of the reciprocating motion so provided. Inertia compensation can be provided through the use of two cranks operating in phase opposition, one driving the part to be reciprocated, the other one driving a compensating mass along parallel paths and in phase opposition thereto but in synchronism thereto.

DESCRIPTION OF THE DRAWINGS

While the specification concludes with claims particularly pointing out and distinctly claiming the subject matter which is regarded as the invention, it is believed that the invention, the objects and features of the invention and further objects, features and advantages thereof will be better understood from the following description taken in connection with the accompanying drawings in which:

Proceeding now to the detailed description of the drawings, FIG. 1 illustrates generally a reciprocating machine part 1 which as a particular example is comprised of a print element carrier 1*a* (see also FIG. 5). Spatially separated therefrom is a drive 2 generally, which specifically may be constructed as a rotating motor 2*a*. The arrangement interposed between the drive 2 and the part 1 generally converts the rotational movement of the motor 2*a* into a linear oscillating, i.e. reciprocating motion tracing a particular velocity profile.

Figure 1:
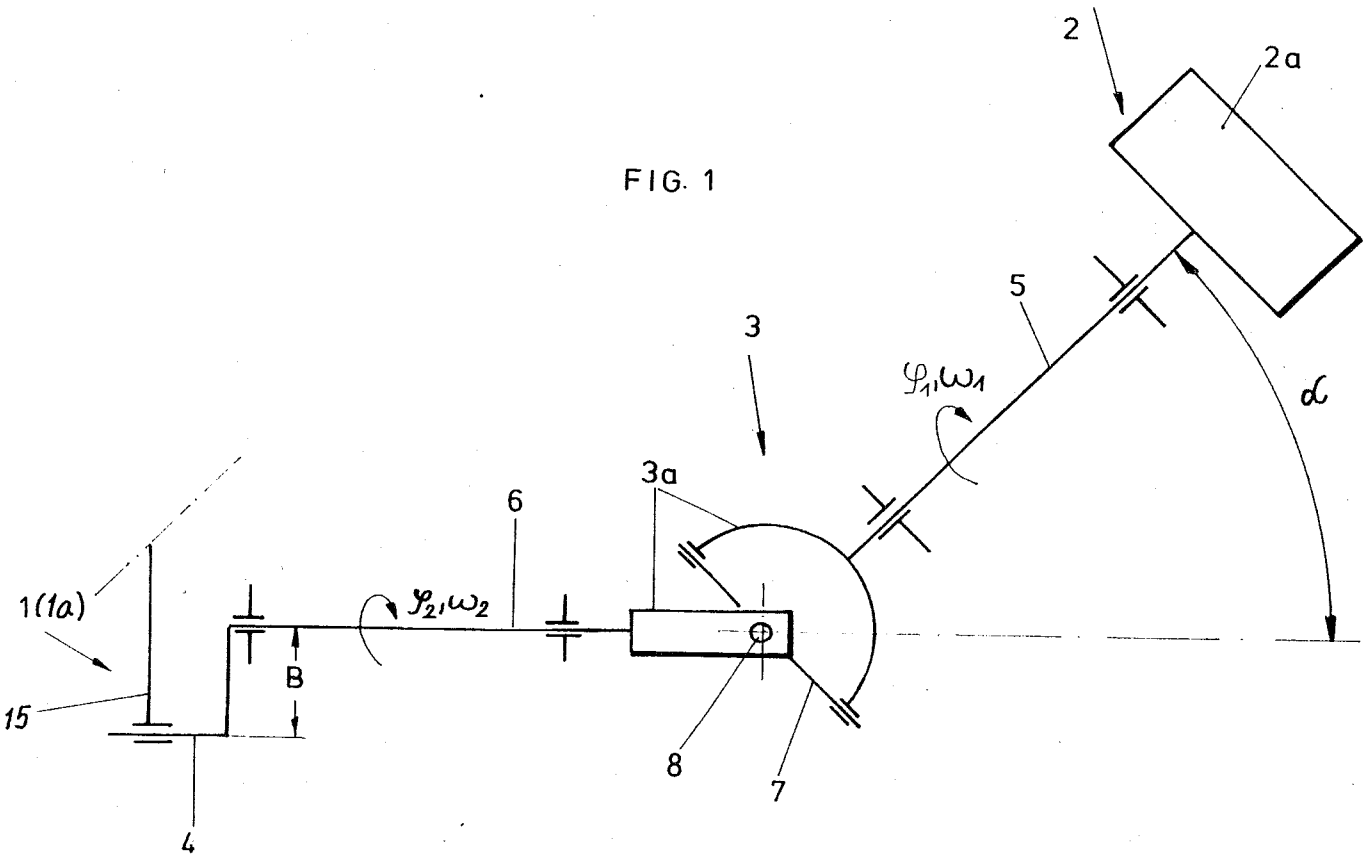
FIG. 1 is a schematic view of the elements pertaining to a shuttle mechanism shown in top elevation and being constructed and arranged in accordance with the preferred embodiment of the present invention for practicing the best mode thereof.

Before proceeding to the detailed description of the structure elements, the operating conditions should be outlined by way of example. For example, a line print element carrier 1*a* may typically reciprocate at a frequency of 30 cycles per second; in some cases the frequency may be lower, but generally speaking still higher frequencies may be required in other cases. The overall displacement, i.e. the peak to peak distance or the distance between the points of reversal of the carrier 1*a* may be about half an inch.

The motor 2*a* has a rotating output shaft 5 which is input shaft for a superposing transmission 3 which includes a universal joint 3*a* as well as an eccentric shaft 4 as output being coupled accordingly to the print element carrier 1*a*. Shaft 4 extends from a crank arm 16 which in turn extends from shaft 6. Then shaft 4 in turn is connected to device 1 by means of a linkage rod 15.

The shaft 4 (see FIG. 2) produces generally a sinusoidal motion following the general relations of a crank drive which is given by $$X = B \cdot \cos(\omega_2 t)$$

Herein X is the displacement path in millimeters, B is a crank length (crank arm 16) also in millimeters, Omega-2 is the angular speed (1/sec) of the output shaft 6 of transmission 3, t is time in seconds and A is the length of the thrust rod 15 in millimeters. Moreover, it is assumed that the so-called linkage ratio A/B is relatively large which can be verified from FIG. 2.

Figure 2:
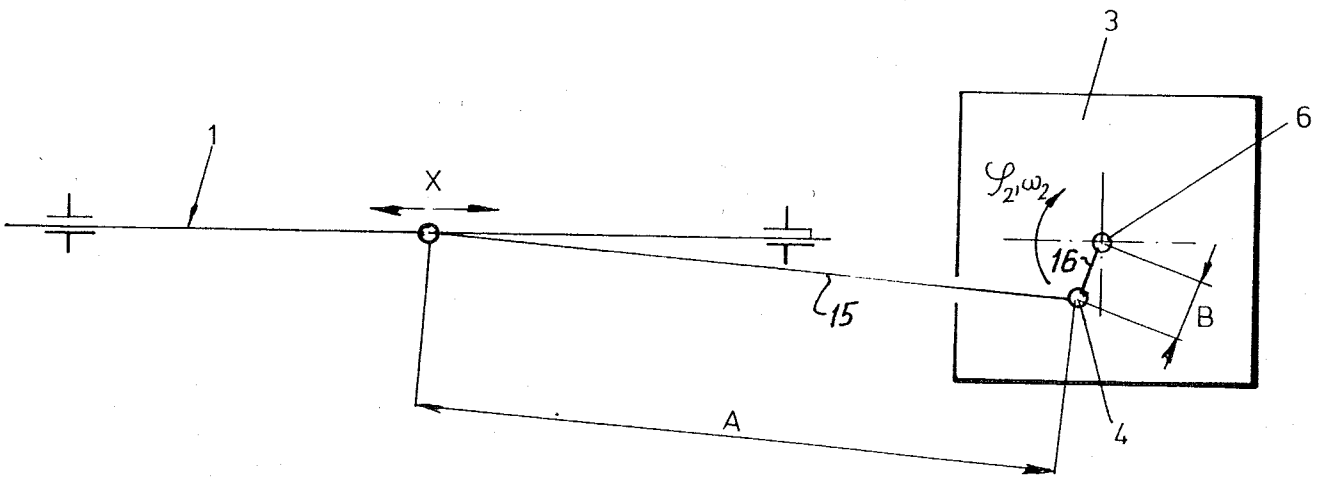
FIG. 2 illustrates a portion of the drive members of the shuttle mechanism particularly in their range of an eccentric shaft in side elevation (from the left in FIG. 1)
Figure 3:
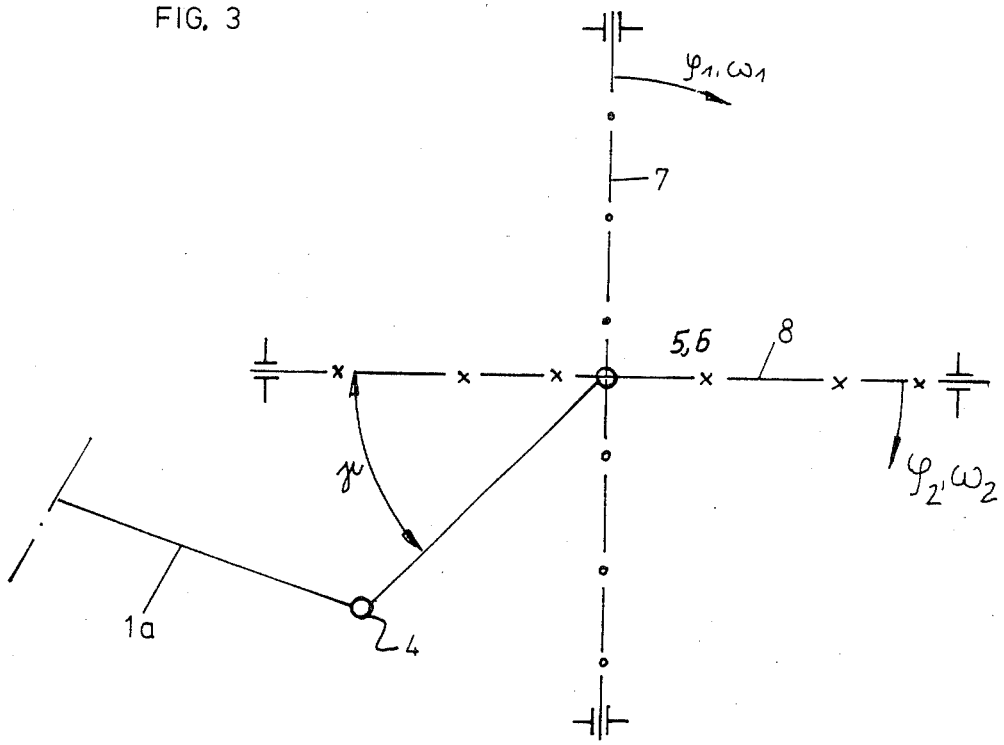
FIG. 3 is a diagram showing various axes in a geometric projection into a common plane to demonstrate motions as they occur in the universal joint included in the mechanism shown in FIGS. 1 and 2.

FIG. 2 teaches that the machine part 1, e.g. the element carrier 1*a* will move sinusoidally, disregarding any modification which may be provided upon superimposing the output of the speed modifying transmission 3. Thus, the velocity varies (oscillates) between maxima in either direction and zero speed at the point of reversal. The superimposing, gearless transmission 3, however, converts the nonlinear speeds particularly around the sinusoidally determined maxima speed into uniform speeds over a particular range.

The superimposing transmission 3 includes a universal joint 3*a* also called a Cardan joint or cross linkage. The input drive shaft, axis 5 as provided by the motor 2*a* is oriented at an angle Alpha to the output axis 6 of the transmission 3 which is between 30° and 50° and preferably 40°. The motor 2*a* drives the shaft 5.

The universal joint 3*a* includes a shaft 7 driven by the output of shaft 5. The shaft 7 revolves about an axis at right angles to the axis of its extension at the constant input speed $\omega_1$. In view of the joint angle Alpha, the constant speed is converted into a nonuniform or nonconstant rotational speed $\omega_2$ at the axis 8 on the output side of the universal joint 3*a*. The crank shaft 16 is phase shifted in relation to the axis 8 by the crank angle Gamma. Depending upon the disposition of the eccentric shaft 4, one can obtain uniform linear speeds in certain sections.

The motion or motor 2*a* can be described by the product of the two parameters $\phi_1$ and $\omega_1$ wherein $\phi_1$ constitutes the angular displacement (modolo $2 \times \mathrm{Pi}$) of the drive shaft 5 and constitutes the constant angular speed of the motor 2*a*. Therefore, the prospective output displacement angle of output shaft 6 (independent from phase angle Gamma) is given by the relation $$\tan \phi_2 = \tan \phi_1 \cos \alpha$$

in addition to the two parameters defined above angle Gamma consitutes the phase angle of crank shaft 16 in relation to axis or shaft 8 (both rotating about the axis or shaft 16).

The ratio of the two angular speeds involved is therefore as follows:

$$\frac{\omega_2}{\omega_1} = \frac{\cos \alpha}{1 - \sin^2\phi_1 \sin^2\alpha}$$

Speeds can be determined from the displacement equation governing the displacement X and which can be written as follows:

$$X = B \cdot \cos[\tan^{-1}(\tan \omega_1 t \cdot \cos \alpha) + \gamma]$$

Figure 4:
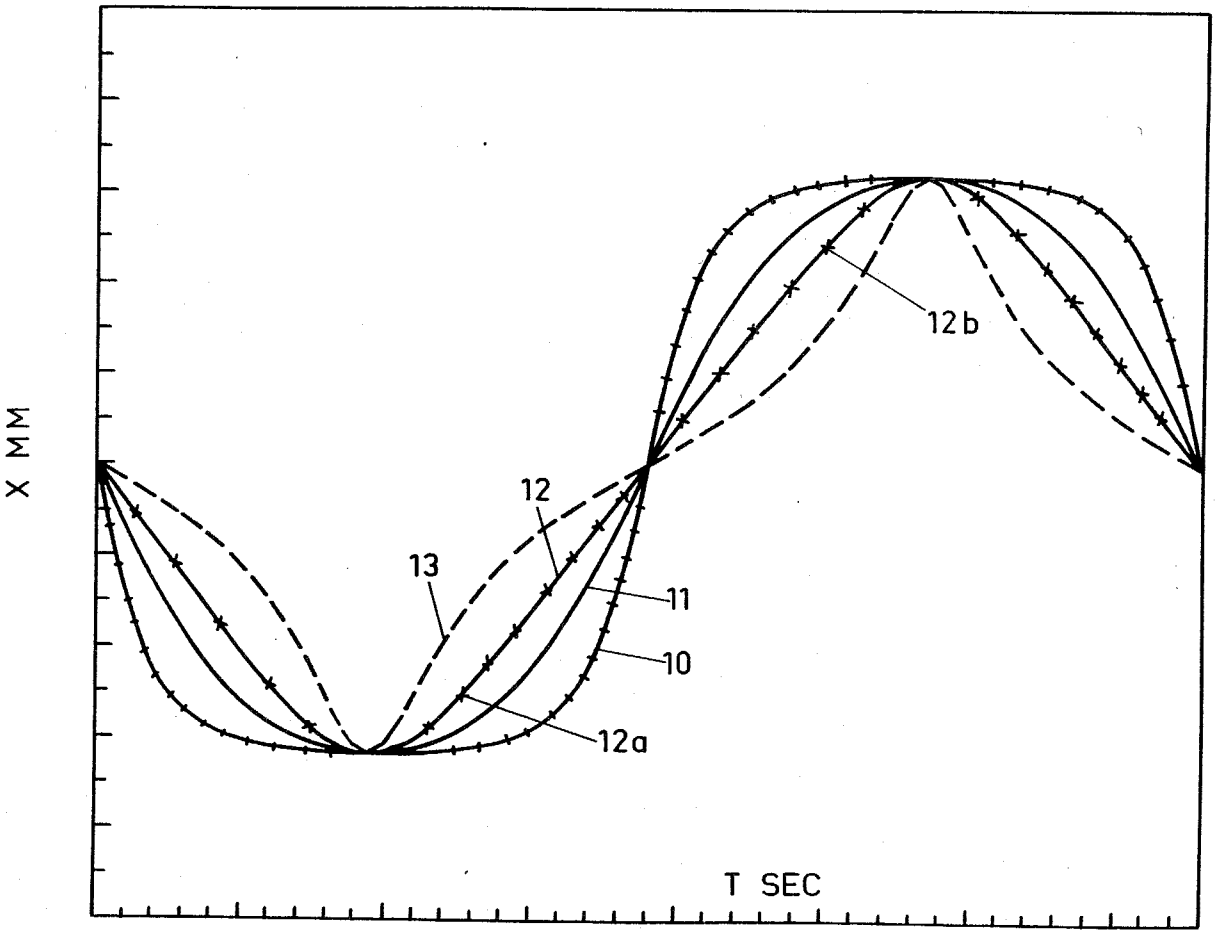
FIG. 4 is a diagram plotted against time and illustrating several modifications for a sinusoidal motion.

FIG. 4 illustrates examples for the modified sinusoidal displacement which indeed shows displacements varying linearly in time over certain sections. A number of curves or traces have been plotted and the parameters involved are as follows:

trace 10: Alpha=70°, Gamma=0
trace 11: Alpha=40°, Gamma=0
trace 12: Alpha=40°, Gamma=90°
trace 13: Alpha=70°, Gamma=90°

It can readily be seen that particularly the trace 12 has a very long linearly varying portion (constant slope) between the points 12*a* and 12*b*, which means that the speed of the part 1 is constant as it traverses that displacement path. Therefore, the speed characteristic has a very long linearly varying portion (constant slope) between the points 12*a* and 12*b*, which means that the speed of the part 1 is constant as it traverses that displacement path. Therefore, this path increment is available for printing by means of the line printer. Trace 10, on the other hand, can be used in those cases in which there is a dependency upon the speed of advance of the print medium. Moreover, it can readily be seen that through a variety of combinations for values of the angles Alpha and Gamma, one will obtain a variety of displacement path and speed profiles.

Figure 5:
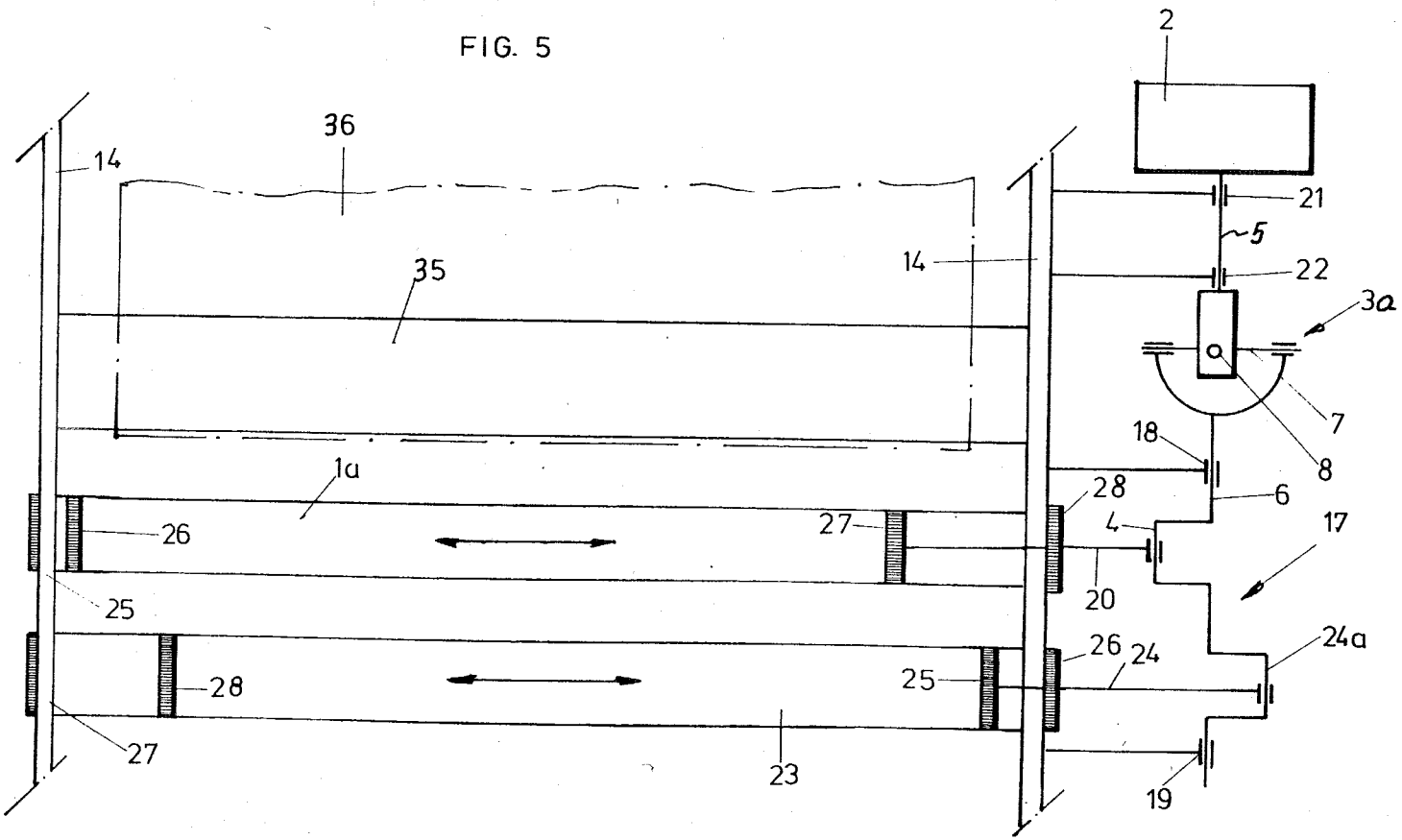
FIG. 5 is a top view of a matrix line printer showing somewhat schematically the most important drive members of the shuttle mechanism shown in FIGS. 1, 2 and 3 and showing particularly their association within the print frame.

After these general remarks, reference is made to FIG. 5 which illustrates specifically the application of the general principles expounded thus far, to the operation of the print element carrier 1*a* in a matrix line printer. Reference numeral 14 refers generally to the frame supporting the platen 35 being constructed as a rotatably mounted cylindrical drum. The print medium such as paper 36 engages the platen 35 and printing is to be had from the other side.

The print element carrier 1*a* is connected to the eccentric shaft 4 constituting a portion of a crank drive 17 being mounted in bearings 18 and 19 for rotation about the axis of shaft 6. The connection between the eccentric crank output shaft 4 and the print element carrier 1*a* is provided through the thrust or linking rod 20. The motor 2 and here, particularly its shaft 5, are mounted for rotation of the shaft 5 in journal bearings 21 and 22 being, of course, also affixed to the frame 14. The transmission 3 is arranged as described and the universal joint 3*a* is however seen in a side elevation which is from the top in FIG. 1. Moreover, the angle Gamma is zero in this case.

In order to compensate the total mass of the shuttle and print element carrier 1*a*, a counterweight 23 is provided and linked to the crank drive 17 by means of a second thrust rod 24. The eccentricity and phase of shaft 24*a* is 180° out-of-phase with regard to the eccentricity of shaft 4 vis-a-vis the axis of shaft 6. A parallel motion of carrier 1*a* and of the counterweight 23 permits the employment of leaf springs 25 and 26 as well as 27 and 28 upon which respectively bear the print element carrier 1*a* and the counterweight 23.

The invention is not limited to the embodiments described above, but all changes and modifications thereof, not constituting departures from the spirit and scope of the invention are intended to be included.

We claim:

1. Apparatus for reciprocating a line printer shuttle along a linear path comprising:

a rotational drive operating at a constant speed and having an output shaft rotating accordingly at a constant angular speed;

a transmission having an input with an input axis and being coupled to the output shaft and providing a rotational output about an output axis arranged obliquely to the input axis, the transmission modifying the constant rotational speed to cyclically vary the speed of the rotational output; and linkage means including a crank connected to the rotational output of the transmission for translating the motion of the rotational output of the transmission into a linear reciprocating motion, said modification of the rotational output of the transmission being such that the reciprocating motion has at least one constant speed section in between respective two sequential reversals.

2. Apparatus as in claim 1, the transmission including a universal joint having said input and output axes arranged to each other at an angle which is not zero to obtain said oblique arrangement, the input axis being connected to the output of the rotational drive, the output axis of the universal joint being connected to the crank of the linkage means.

3. Apparatus as in claim 2, the universal joint including at least one cross link.

4. Apparatus as in claim 2, said angle being between 30° and 50°.

5. Apparatus as in claim 2, the crank having an arm having a phase shift angle in relation to the output of the universal joint.

6. Apparatus as in claim 1, the linkage means including two cranks, the first one being connected to said shuttle, the second one being connected to a compensating mass for inertia compensation, the two cranks moving in synchronism but phase opposition.

7. In a matrix printer having a print element carrier extending along a platen and provided for reciprocating movement along a linear path therealong, an apparatus comprising a rotational drive operating at a constant speed and having an output shaft rotating accordingly at a constant angular speed;

a gearless transmission having an input coupled to the shaft and providing rotational output, the transmission modifying the constant angular speed to cyclically vary the speed of the rotational output; and linkage means connected to the rotational output of the transmission for translating the motion of the rotational output thereof into a linear reciprocating motion for said reciprocating print element carrier, said modification of the rotational output being such that the reciprocating motion of the print element carrier has at least one relatively long constant speed section in between respective two sequential reversals.

8. Apparatus as in claim 7, said linkage means being a crank.

9. Apparatus as in claim 8, the transmission including a universal joint having an input and an output axis arranged to each other at an angle which is not zero, the input axis of the universal joint being connected to the output of the rotational drive, the output of the universal joint being connected to turn said crank.

10. Apparatus as in claim 9, wherein said angle is approximately 40°.

11. Apparatus as in claim 7, the linkage means including two cranks, the first one being connected to said reciprocating print carrier, a second one of the two cranks being connected to a compensating mass for inertia compensation, the compensating movement occurring parallel to the reciprocating print element carrier in synchronism therewith but in phase opposition thereto.

* * * * *